US007886713B2

(12) United States Patent
Vichinsky

(10) Patent No.: US 7,886,713 B2
(45) Date of Patent: Feb. 15, 2011

(54) LOWER INTAKE MANIFOLD WITH CHARGE MOTION CONTROL VALVE

(75) Inventor: Kevin Vichinsky, Portage, MI (US)

(73) Assignee: Mann + Hummel GmbH, Ludwigsburg (DE)

( * ) Notice: Subject to any disclaimer, the term of this patent is extended or adjusted under 35 U.S.C. 154(b) by 349 days.

(21) Appl. No.: 12/113,744

(22) Filed: May 1, 2008

(65) Prior Publication Data

US 2008/0271697 A1 Nov. 6, 2008

Related U.S. Application Data

(60) Provisional application No. 60/924,166, filed on May 2, 2007.

(51) Int. Cl.
*F02B 31/04* (2006.01)

(52) U.S. Cl. ..... 123/306; 123/337; 123/188.14

(58) Field of Classification Search ..... 123/306, 123/308.336, 337, 188.14
See application file for complete search history.

(56) References Cited

U.S. PATENT DOCUMENTS

| | | | | | |
|---|---|---|---|---|---|
| 4,413,598 | A * | 11/1983 | Tsutsumi | ..... | 123/306 |
| 5,477,823 | A * | 12/1995 | Uchida | ..... | 123/308 |
| 5,551,392 | A * | 9/1996 | Yamaji et al. | ..... | 123/306 |
| 5,575,249 | A | 11/1996 | Mielke et al. | | |
| 5,642,697 | A | 7/1997 | Jahrens et al. | | |
| 5,875,758 | A * | 3/1999 | Fujita | ..... | 123/336 |
| 6,662,772 | B1 * | 12/2003 | Murphy | ..... | 123/184.21 |
| 6,705,280 | B1 * | 3/2004 | Lippert | ..... | 123/306 |
| 6,827,060 | B2 * | 12/2004 | Huh | ..... | 123/336 |
| 7,096,849 | B1 * | 8/2006 | Mathis et al. | ..... | 123/306 |
| 7,293,546 | B1 * | 11/2007 | Confer et al. | ..... | 123/308 |
| 7,624,715 | B2 * | 12/2009 | Goldin et al. | ..... | 123/336 |
| 2002/0124826 | A1 | 9/2002 | Corduan et al. | | |
| 2004/0149248 | A1 | 8/2004 | Koch et al. | | |
| 2005/0005890 | A1 | 1/2005 | Asfaw et al. | | |
| 2005/0189513 | A1 * | 9/2005 | Ino et al. | ..... | 251/308 |
| 2006/0231054 | A1 | 10/2006 | Khami et al. | | |
| 2008/0035107 | A1 * | 2/2008 | Torii | ..... | 123/336 |
| 2010/0018496 | A1 * | 1/2010 | Fornara et al. | ..... | 123/306 |

FOREIGN PATENT DOCUMENTS

| | | | |
|---|---|---|---|
| DE | 196 09 305 | A1 | 9/1996 |
| EP | 1 085 197 | A2 | 3/2001 |
| GB | 2 299 375 | A | 10/1996 |
| GB | 2 413 157 | A | 10/2005 |
| WO | WO 00/26516 | A1 | 5/2000 |

OTHER PUBLICATIONS

European Search Report dated Aug. 19, 2008 (Six (6) pages).

* cited by examiner

*Primary Examiner*—Erick Solis

(57) ABSTRACT

A lower intake manifold assembly includes a lower housing and a runner insert fitted into the lower housing. The lower housing may be made of metal and the runner insert may advantageously be made of a synthetic resin material. The runner insert provides a sealing surface between the lower housing and the cylinder head of an internal combustion engine. The runner insert also supports a charge motion control valve flap assembly that advantageously may include a shaft and synthetic resin flaps over-molded onto the shaft.

19 Claims, 3 Drawing Sheets

LOWER INTAKE MANIFOLD WITH CHARGE MOTION CONTROL VALVE

BACKGROUND OF THE INVENTION

The invention relates to a lower intake manifold assembly for an internal combustion engine. The lower intake manifold assembly includes a charge motion control valve (CMCV).

It is known that engine performance can be improved by controlling the amount of gas turbulence (e.g., swirl and/or tumble) within the engine's combustion chambers. In order to modify the flow of air and air-fuel gas mixtures and generate such turbulence, charge motion control valves are incorporated into the air induction system of internal combustion engines.

Typically, charge motion control valves (CMCV's) are integrated within the upper intake manifold of an air induction system where packaging and assembly is easier and thus more economical than positioning the CMCV's further downstream. It would be an advantage, however, to provide CMCV's proximate to the combustion chambers (i.e., downstream of the upper intake manifold) where their effect would be more pronounced.

SUMMARY OF THE INVENTION

It is therefore one object of the invention to provide a charge motion control valve (CMCV) that is incorporated within a lower intake manifold of an internal combustion engine.

A further object of the invention is to provide a CMCV-integrated lower intake manifold that is compatible with existing air induction systems, easy to install, and which provides enhanced engine performance, fuel economy and reduced emissions.

These and other objects and advantages of the invention are achieved by a lower intake manifold assembly comprising a synthetic resin insert which provides sealing surfaces between a housing of the lower intake manifold assembly and the cylinder head of the engine, and which also comprises a plurality of support rails for a flap assembly that, together with the insert, define a plurality of charge motion control valves.

According to one embodiment, the lower intake manifold assembly includes a lower housing having a plurality of first air/fuel flow apertures, a runner insert having a plurality of second air/fuel flow apertures attached to the lower housing, and a flap assembly that is supported by the runner insert between the runner insert and the lower housing. In a particularly preferred embodiment, the flap assembly comprises a metal shaft and synthetic resin flaps that are over-molded onto the shaft. The runner insert, which is made of a synthetic resin material, includes support rails that rotatably support the shaft such that each flap is aligned with a respective pair of first and second air/fuel flow apertures.

The runner insert includes an upper sealing surface for forming a fluid-tight seal between the runner insert and the lower housing, and a lower sealing surface for forming a fluid-tight seal between the runner insert and the cylinder head of the engine.

According to a further aspect of the invention, a method of forming a lower intake manifold assembly comprises forming a flap assembly by over-molding a plurality of synthetic resin flaps onto a metal shaft, supporting the flap assembly on support rails of a runner insert to define a plurality of CMCV's, and attaching the runner insert with the supported flap assembly to a housing having a plurality of first air/fuel flow apertures such that both the flaps and the second air/fuel flow apertures formed in the runner insert align with respective first air/fuel flow apertures formed in the housing.

These and other features of preferred embodiments of the invention, in addition to being set forth in the claims, are also disclosed in the specification and/or in the drawings, and the individual features each may be implemented in embodiments of the invention either individually or in the form of sub-combinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
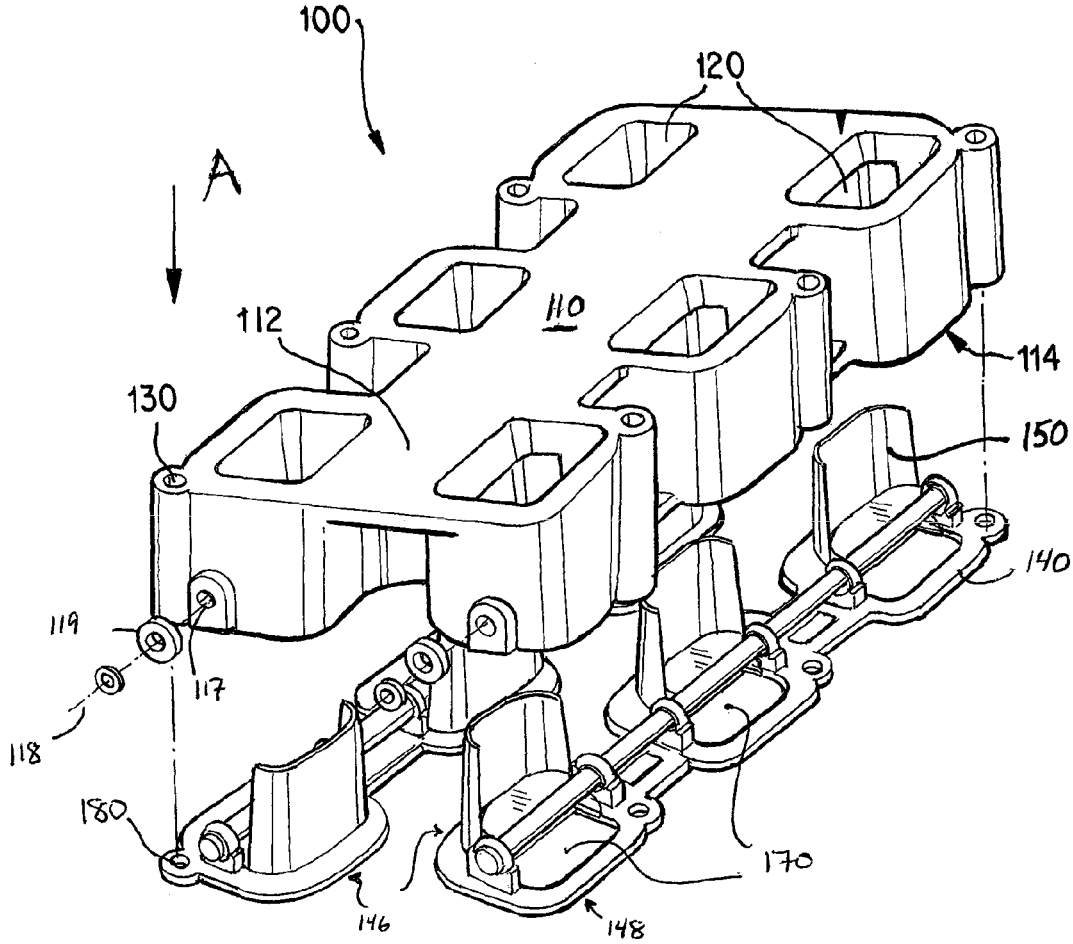
FIG. 1 is an exploded view of a lower intake manifold assembly according to the present invention.

FIG. 1 is an exploded view of a lower intake manifold assembly 100 according to one embodiment. The lower intake manifold assembly 100 includes a lower housing 110 having an upstream face 112 and a downstream face 114. A plurality of first air/fuel flow apertures 120 are formed in and extend through the lower housing from the upstream face 112 to the downstream face 114. A preferred lower housing 110 includes one air/fuel flow aperture per cylinder of the engine. As illustrated, the principal direction of air flow through the lower housing during normal engine operation is in the direction from the upstream face 112 to the downstream face 114 indicated by arrow A.

The lower housing 110 is preferably made from aluminum or an aluminum alloy, although it may be made from other metals, alloys, synthetic resins, or composites. An aluminum lower housing can be made by, for example, die casting, sand casting, or injection molding. The lower housing illustrated in FIG. 1 is substantially in the shape of a rectangular prism, having a length L, width W, and thickness T. The lower housing 110 provides a rigid support to which additional components in the air induction system can be attached.

In an assembled air induction system, the upstream face 112 of the lower housing 110 is attached to an upper intake manifold (not shown). Attachment apertures 130 are provided in the lower housing to attach the lower housing to the upper intake manifold, which can be secured using conventional fasteners such as bolts.

Figure 2:
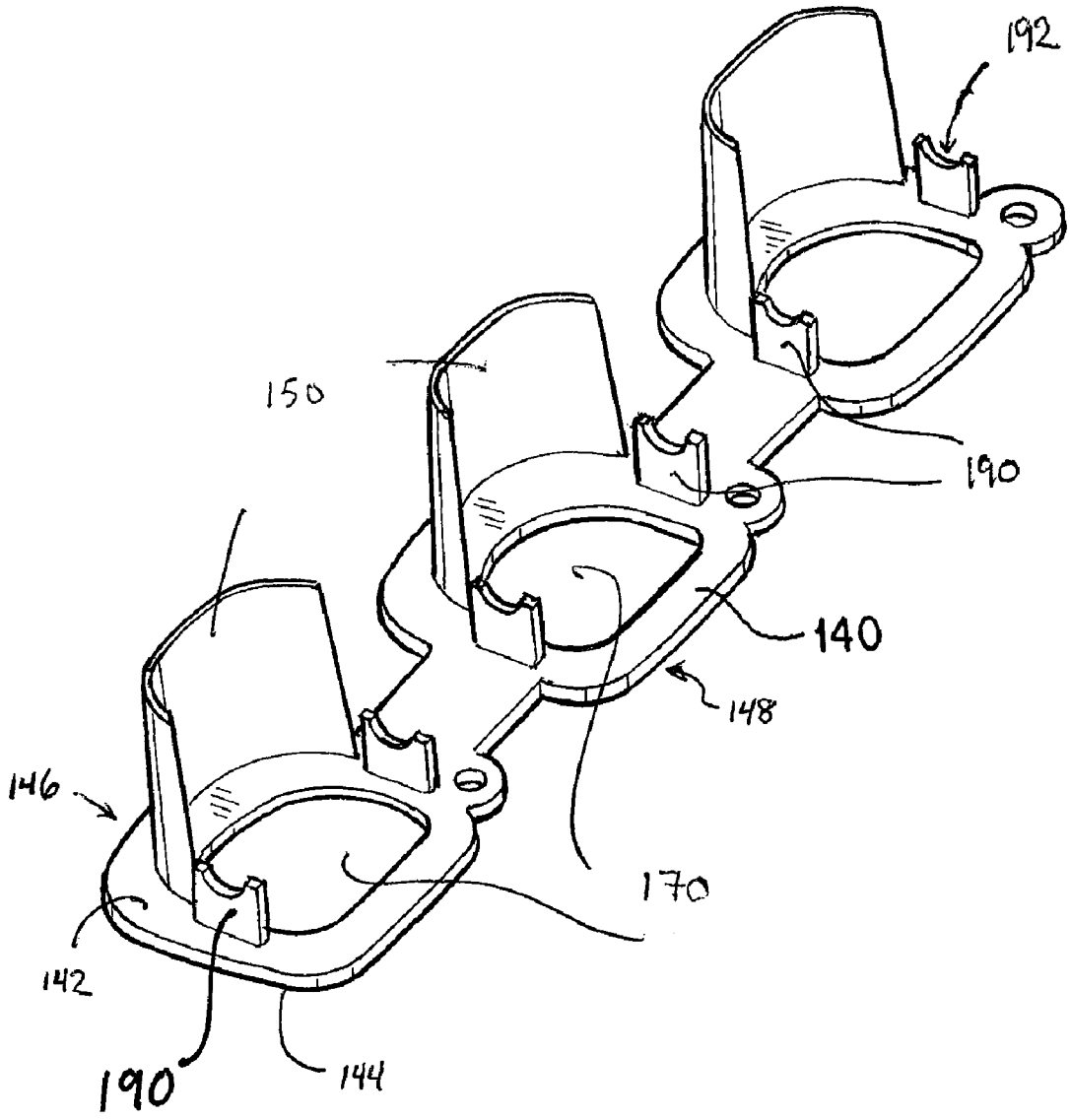
FIG. 2 is a perspective view of a runner insert.
Figure 3:
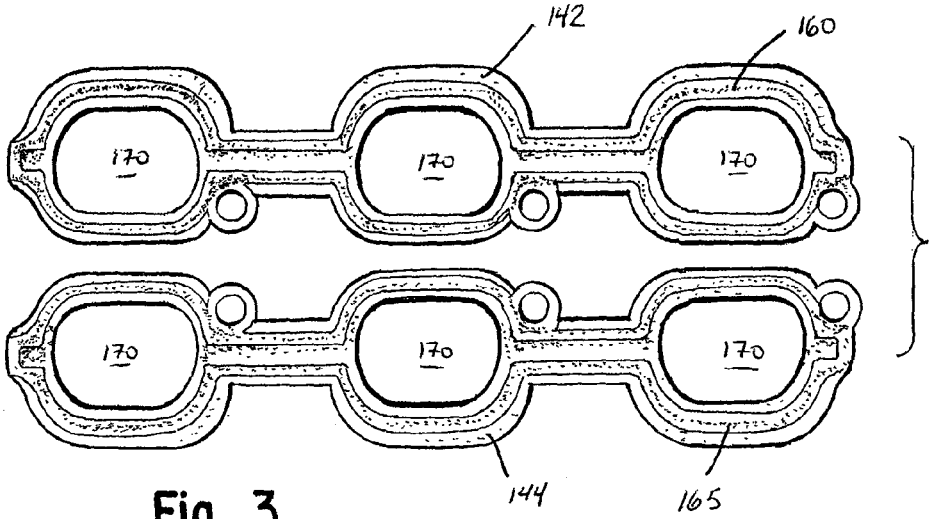
FIG. 3 is an upper and lower end view of a runner insert showing sealing surfaces.

Referring to FIGS. 1-3, the lower intake manifold assembly 100 also includes a pair of runner inserts 140. Preferably, one runner insert is provided for each bank of cylinders in the engine. Each runner insert includes a plurality of second air/fuel flow apertures 170 that are configured to align with respective first air/fuel flow apertures 120 formed in the lower housing. Further, both sets of air/fuel flow apertures 120, 170 are sized and shaped to approximate the size and shape of respective intake ports in the cylinder head. A perspective view of a runner insert is shown in FIG. 2.

Each runner insert has an upstream face 142 and a downstream face 144. The upstream face 142, which has an inner edge 146 and an outer edge 148, is joined to and forms a seal with a lower surface 114 of the lower housing 110. In particular, an upper seal 160 formed on the upstream face 142 of each runner insert forms a fluid-tight seal between the runner insert and the lower housing. In a similar vein, a lower seal 165 formed on the downstream face 144 of each runner insert forms a fluid-tight seal between the runner insert and the cylinder head to which the lower manifold is mounted (not shown).

As shown in FIG. 3, upper and lower seals 160, 165 are formed along peripheral regions of the respective upstream and downstream faces 142, 144. The peripheral regions run substantially around each of the air/fuel flow apertures 170. Upper and lower seals 160, 165 can be over-molded, edge molded or pressed into place. Further, while gasket-type seals are shown, alternate seals may, for example, include an O-ring and cooperating O-ring groove. Thus, the runner insert provides sealing surfaces by which the housing can be attached to the cylinder head, in addition to providing the functionality described below.

Referring back to FIG. 2, the upstream face 142 of each runner insert comprises a plurality of alignment fins 150. The alignment fins 150 are positioned between upper seal 160 and a respective air/fuel flow aperture 170 along an arc on the inside edge 146 of the upstream face 142. The alignment fins 150 extend upwardly from the upstream face 142 to a height above the upstream face 142 of less than the thickness T of the lower housing.

Also formed on each runner insert are support rails 190. The support rails 190 are defined by upwardly-extending portions each preferably having a substantially semicircular groove 192 at an upper end thereof. According to one preferred embodiment, one pair of support rails are provided adjacent to each second air/fuel flow aperture 170 such that, as illustrated in FIGS. 1 and 2, a runner insert having three air/fuel flow apertures has six support rails.

It is to be understood that while a lower intake manifold assembly 100 having six air/fuel flow apertures and a total of 12 support rails is shown, the lower intake manifold assembly according to the invention may comprise fewer or additional support rails 190 and/or air/fuel flow apertures 120, 170 depending on, for example, the number of cylinders in the engine.

Referring still to FIG. 2, support rails 190 are configured in a co-linear arrangement to support a flap assembly 200. The flap assembly 200 comprises a shaft 210 to which a plurality of flaps 220 are attached. Preferably, the flaps are made of a synthetic resin material and are over-molded onto the shaft. The flaps 220 are sized and positioned to align with respective first and second air/fuel flow apertures 120, 170 when the flap assembly is supported by the runner insert. The shaft 210, which is preferably a machined stainless steel rod, can have any suitable dimensions, but a particularly preferred shaft has a diameter of about 4 mm.

Figure 4:
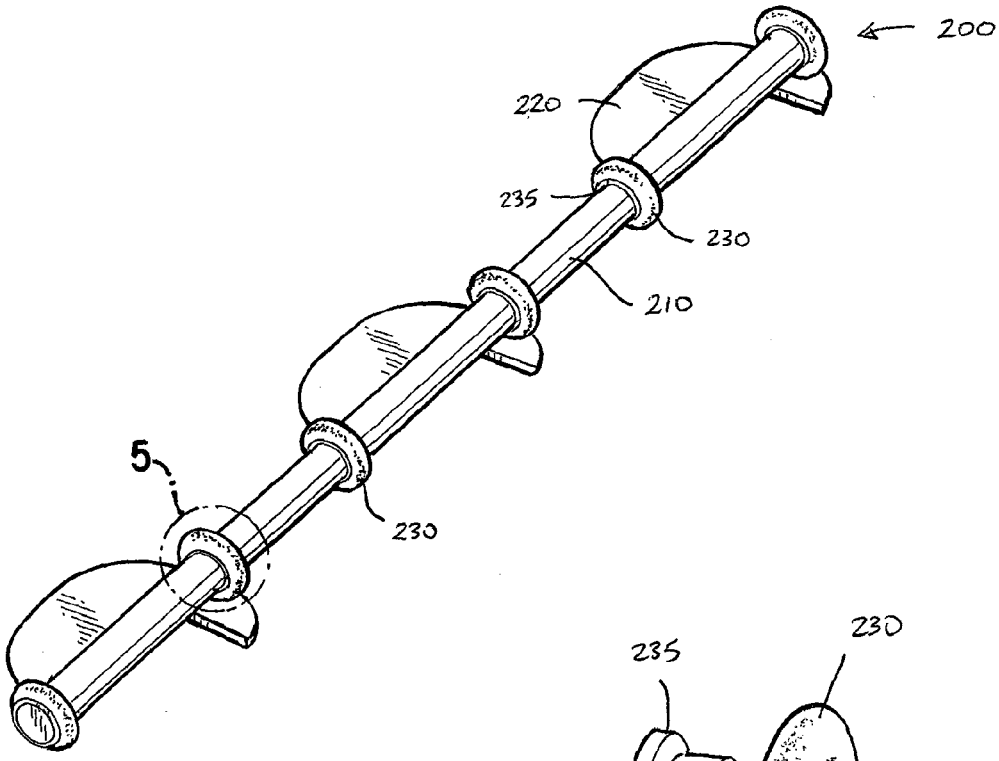
FIG. 4 is a perspective view of a flap assembly.
Figure 5:
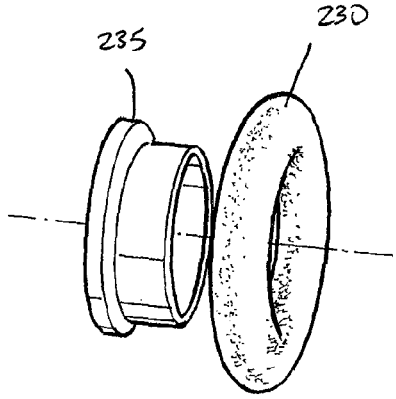
FIG. 5 is an O-ring/bearing assembly.

The shaft 210 is also provided at discrete locations with O-rings 230 that are fitted over sleeve bearings 235. The O-ring/bearing assemblies, an example of which is shown in FIGS. 4 and 5, are fitted over shaft 210 such that each O-ring is supported by a respective groove 192 of a support rail 190. The O-rings can be made from rubber or other suitably resilient material and function both to accommodate inter-part tolerances during assembly of the lower intake manifold assembly and to reduce vibrations during operation of the engine. The spacing between the O-rings on the shaft corresponds to the spacing between the support rails formed on the runner insert.

By inserting shaft 210 through sleeve bearings 235, the shaft is freely rotatable. During operation of the engine, a control unit (not shown) can be used to rotate shaft 210 and flaps 220 to a desired position in order to achieve a desired degree of downstream turbulence. Each shaft 210 can be connected to the control unit via apertures 117 that extend through the lower housing 110 using connectors 118, 119 (FIG. 1).

In operation, flaps 220 can be rotated with shafts 210 to block off a desired portion of first and second air/fuel flow apertures and produce a swirl or tumble-type air flow of gases entering each cylinder. As defined herein, with swirl-type flow, the gases rotate about a longitudinal axis of the cylinders, and with tumble-type flow, the gases rotate about an axis that is perpendicular to the longitudinal axis of the cylinders.

Advantageously, the flap assembly is provided as a separate part that is configured to be supported by the support rails when the runner inserts are inserted into the lower housing. By providing the flap assembly in this manner, it is not necessary to drill (e.g., gun drill) an aperture through the lower housing in order to mount a shaft and then subsequently attach a plurality of flaps to the mounted shaft, as is done conventionally. Further, according to an alternative embodiment, in engines where a CMCV is not desired, the flap assembly 200 can easily be omitted when assembling the lower intake manifold assembly.

The runner inserts 140, flaps 220 and sleeve bearings 235 are preferably made from one or more synthetic resin materials such as polyimides, polyesters and nylons. Exemplary synthetic resin materials include PA-66 and GF-30, which are commercially available. Injection molding is a preferred process for forming parts made of a synthetic resin material. In particular, each runner insert is preferably a unitary part such that the main body of the runner insert, the support rails, and the alignment fins comprise a single piece that can be made, for example, by injection molding.

A method of assembling the lower intake manifold assembly 100 includes supporting a flap assembly 200 on the support rails 190 of a runner insert 140, and attaching the runner insert 140 to a downstream face 114 of a lower housing. According to a preferred embodiment, the runner inserts can be press-fitted or snap-fitted into place and then secured to the lower housing attachment apertures 130, 180 in combination with bolts or other attachment fixtures. Attachment apertures 180 formed in the runner inserts preferably align with attachment apertures 130 formed in the lower housing. As noted above, these attachment apertures 130, 180 can also be used to secure the lower intake manifold assembly to both to an upper manifold and a cylinder head. According to a preferred embodiment, when an upper intake manifold, lower housing 110, runner inserts 140 and cylinder head are fastened together, fluid tight seals are formed along respective interfaces between the parts.

Preferably, the upper intake manifold, lower intake manifold assembly, and cylinder head are manufactured and assembled separately and are all connected together with common fasteners during assembly of the engine.

By providing runner inserts 140 made of a synthetic resin material, the runner inserts are relatively inexpensive, and different runner inserts can be used in conjunction with an aluminum lower housing to generate different runner geometries within the lower intake manifold. This modular design allows manufacturers to make adjustments to the engine dynamics during assembly of the engine without the need to retool the aluminum lower housing.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. A lower intake manifold assembly, comprising:

a housing including a plurality of first flow apertures;

at least one runner insert attached to the housing, said runner insert having a plurality of second flow apertures, each of said second flow apertures arranged downstream of and aligned with respect one of said first flow apertures, the at least one runner insert including a plurality of alignment fins that each extend from an upstream face of the runner insert into a respective one of said first flow apertures of said housing such that said alignment fins are insertably received into said housing;

a plurality of support rails and a plurality of second flow apertures, each of the second flow apertures aligned with a respective one of the first flow apertures; and a flap assembly including a shaft rotatably supported on the support rails between the housing and the runner insert, the shaft having attached thereto a plurality of flaps, each of the flaps aligned with a respective first aperture and a respective second flow aperture to form a charge motion control valve.

2. The assembly according to claim 1, wherein the at least one runner insert includes an upper sealing surface for forming a seal between the runner insert and the housing, and a lower sealing surface for forming a seal between the runner insert and a cylinder head of an engine.

3. The assembly according to claim 1, wherein the flap assembly comprises a metal shaft and synthetic resin flaps over-molded onto the shaft.

4. The assembly according to claim 1, wherein the housing is made of aluminum or an alloy thereof.

5. The assembly according to claim 1, wherein the at least one runner insert is formed from a synthetic resin material.

6. The assembly according to claim 1, wherein the shaft is overfitted with a plurality of O-rings that are supported by the support rails.

7. The assembly according to claim 6, wherein each O-ring is fitted over a sleeve bearing that is fitted over the shaft.

8. The assembly according to claim 6, wherein the support rails include a substantially semicircular groove at one end for supporting the O-rings.

9. An air intake system of an internal combustion engine comprising the lower intake manifold assembly according to claim 1.

10. A method of forming a lower intake manifold assembly of claim 1, comprising:

attaching a plurality of flaps to a shaft to form a flap assembly;

supporting the flap assembly on a plurality of support rails formed on a runner insert; and attaching at least one runner insert including the supported flap assembly to a housing, wherein the flap assembly is rotatably supported between the housing and the runner insert, each of the first flow apertures is aligned with a respective one of a plurality of second flow apertures formed in the runner insert, and each flap is aligned with a respective first and second flow aperture to form a charge motion control valve.

11. The method according to claim 10, wherein the at least one runner insert includes an upper sealing surface for forming a seal between the runner insert and the housing, and a lower sealing surface for forming a seal between the runner insert and a cylinder head of an engine.

12. The method according to claim 10, wherein the shaft is made of metal and the flaps are made of a synthetic resin material.

13. The method according to claim 10, wherein the flaps are over-molded onto the shaft.

14. The method according to claim 10, wherein the housing is made of aluminum or an alloy thereof.

15. The method according to claim 10, wherein the at least one runner insert is formed from a synthetic resin material.

16. The method according to claim 10, wherein the shaft is overfitted with a plurality of O-rings that are supported by the support rails.

17. The method according to claim 16, wherein each O-ring is fitted over a sleeve bearing that is fitted over the shaft.

18. The method according to claim 16, wherein the support rails include a substantially semicircular groove at one end for supporting the O-rings.

19. The method according to claim 16, wherein the at least one runner insert includes a plurality of alignment fins that extend from a face of the runner insert into a respective first flow aperture.

* * * * *